US009389553B2

(12) United States Patent
Yamamoto et al.

(10) Patent No.: US 9,389,553 B2
(45) Date of Patent: Jul. 12, 2016

(54) FIXING DEVICE AND IMAGE FORMING APPARATUS

(71) Applicant: KONICA MINOLTA, INC., Tokyo (JP)

(72) Inventors: Mineo Yamamoto, Toyokawa (JP); Isao Watanabe, Toyohashi (JP); Yasutaka Tanimura, Nara (JP); Hiroshi Hiraguchi, Toyokawa (JP); Hiroshi Yamaguchi, Toyokawa (JP); Toshinori Inomoto, Toyokawa (JP)

(73) Assignee: KONICA MINOLTA, INC., Chiyoda-Ku Tokyo (JP)

( * ) Notice: Subject to any disclaimer, the term of this patent is extended or adjusted under 35 U.S.C. 154(b) by 0 days.

(21) Appl. No.: 14/666,456

(22) Filed: Mar. 24, 2015

(65) Prior Publication Data

US 2015/0286174 A1 Oct. 8, 2015

(30) Foreign Application Priority Data

Apr. 3, 2014 (JP) ..... 2014-076903

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69
See application file for complete search history.

(56) References Cited

U.S. PATENT DOCUMENTS

2010/0239297 A1* 9/2010 Sakaya ..... G03G 15/2053 399/69
2013/0100507 A1* 4/2013 Takaki ..... B41J 11/008 358/494
2014/0227000 A1* 8/2014 Kitahara ..... G03G 15/2039 399/69
2014/0270835 A1* 9/2014 Umezawa ..... G03G 15/2042 399/69

FOREIGN PATENT DOCUMENTS

JP 9-096991 A 4/1997
JP 2003-307964 A 10/2003

* cited by examiner

*Primary Examiner* — Francis Gray
(74) *Attorney, Agent, or Firm* — Buchanan Ingersoll & Rooney PC

(57) ABSTRACT

A fixing device includes: a plurality of heating units which individually heat a plurality of areas of a fixing member; an acquisition unit which acquires information on an image forming range and a non-image forming range of the recording sheet for each of the plurality of divided heating areas; and a control unit which performs first control for controlling the corresponding heating unit such that a contact portion of the image forming range of the recording sheet has a target fixing temperature when the image forming range contacts the fixing member at the contact portion of the image forming range, and second control for controlling the corresponding heating unit such that a contact portion of the non-image forming range of the recording sheet has a temperature lower than the fixing temperature when the non-image forming range contacts the fixing member at the contact portion of the non-image forming range.

5 Claims, 12 Drawing Sheets

FIG. 7

TEMPERATURE LEVEL DETERMINATION TABLE

| N \ M | 1 | 2 | 3 | 4 | 5 |
|---|---|---|---|---|---|
| 1 | 1 | 1 | 1 | 1 | 1 |
| 2 | 1 | 2 | 2 | 2 | 1 |
| 3 | 1 | 2 | 3 | 2 | 1 |
| 4 | 2 | 2 | 3 | 2 | 1 |
| 5 | 2 | 3 | 3 | 2 | 2 |
| 6 | 2 | 3 | 3 | 3 | 2 |
| 7 | 2 | 3 | 3 | 3 | 2 |

FIXING DEVICE AND IMAGE FORMING APPARATUS

The entire disclosure of Japanese Patent Application No. 2014-076903 filed on Apr. 3, 2014 including description, claims, drawings, and abstract are incorporated herein by reference in its entirety.

BACKGROUND OF THE INVENTION

1. Field of the Invention

The present invention relates to a fixing device which fixes a toner image transferred to a recording sheet, and an image forming apparatus including this fixing device.

2. Description of the Related Art

An electrographic image forming apparatus, such as a copying machine and a printer, includes a fixing device which thermally fixes a toner image transferred to a recording sheet.

Power consumed by the fixing device occupies a large proportion of power consumption of the image forming apparatus, wherefore power saving of the fixing device is essential in promoting energy saving of the image forming apparatus.

For meeting this demand, for example, JP 2003-307964 A discloses a technology which divides a fixing rotating body of the fixing device (cylindrical fixing film) into areas in a main scanning direction to individually heat the respective areas. Each of the areas is determined either as an area where an image is to be formed (image area), or as a non-image area based on image information on images to be formed. The temperature of the fixing rotating body corresponding to the image areas is maintained at a fixing temperature. The temperature of the non-image areas is adjusted to a temperature lower than the fixing temperature.

By setting the temperature of the non-image areas to a temperature lower than the fixing temperature during heating, reduction of power consumption is achievable.

In recent years, the temperature rising speed of the fixing device is increasing, up to a speed as high as 20° C./sec. or higher in some cases, with further reduction of heat capacities of the fixing rotating body and surrounding components for the purpose of further promotion of energy saving.

With increase in the temperature rising speed, a rapid temperature change is produced between the image areas and the non-image areas. This rapid temperature change may cause a problem of crinkling of the recording sheet after fixation.

SUMMARY OF THE INVENTION

The present invention has been developed in consideration of the aforementioned problems. An object of the present invention is to provide a fixing device and an image forming apparatus including this fixing device, capable of individually heating areas divided in a main scanning direction for the purpose of energy saving, and also preventing crinkling of a recording sheet even at a higher temperature rising speed.

To achieve the abovementioned object, according to an aspect, a fixing device which brings a recording sheet into contact with a heated fixing member for thermal fixation of the recording sheet where a not-fixed toner image is formed, while conveying the recording sheet in a sub scanning direction, the fixing device reflecting one aspect of the present invention comprises: a plurality of heating units which individually heat a plurality of areas of the fixing member divided in a main scanning direction; an acquisition unit which acquires information on an image forming range and a non-image forming range of the recording sheet for each of the plurality of divided heating areas, the image forming range being a range where the toner image is formed in the sub scanning direction, and the non-image forming range being a range where the toner image is not formed in the sub scanning direction; and a control unit which performs first control for controlling the corresponding heating unit such that a contact portion of the image forming range of the recording sheet has a target fixing temperature for each of the heating areas when the image forming range contacts the fixing member at the contact portion of the image forming range, and second control for controlling the corresponding heating unit such that a contact portion of the non-image forming range of the recording sheet has a temperature lower than the fixing temperature for each of the heating areas when the non-image forming range contacts the fixing member at the contact portion of the non-image forming range, wherein, in the second control, the control unit changes the heating target temperature of the respective heating units in stages and/or in succession such that a temperature change amount per unit distance of the recording sheet after fixation does not become a predetermined value or larger both in the sub scanning direction and the main scanning direction.

The control unit preferably includes a fixing temperature changing unit which changes the target fixing temperature in accordance with a thickness of the recording sheet, or a toner application amount per unit area in the image forming range of the recording sheet, and in changing the heating target temperature in stages in the second control, the control unit preferably increases the number of changeable levels of the heating target temperature as the target fixing temperature rises.

The control unit preferably includes a fixing temperature changing unit which changes the target fixing temperature in accordance with a thickness of the recording sheet, or a toner application amount per unit area in the image forming range of the recording sheet, and in changing the heating target temperature in stages in the second control, the control unit preferably increases at least the area of the heating area set to a heating target temperature closest to the target fixing temperature as the target fixing temperature rises.

The acquisition unit preferably divides each of the heating areas of the recording sheet into blocks each of which has a predetermined length in the sub scanning direction, determines whether or not the toner image is present for each of the blocks, and acquires information on the image forming range and the non-image forming range.

An image forming apparatus preferably includes the fixing device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 7 is a view illustrating an example of a temperature level determination table referred to by the control unit in performing the temperature control illustrated in FIG. 6;

DESCRIPTION OF THE PREFERRED EMBODIMENTS

Hereinafter, an embodiment of the present invention will be described with reference to the drawings. However, the scope of the invention is not limited to the illustrated examples.

A tandem color printer (hereinafter abbreviated as "printer") is herein described as an example of an image forming apparatus according to an embodiment of the present invention.

(1) General Configuration of Printer

Figure 1:
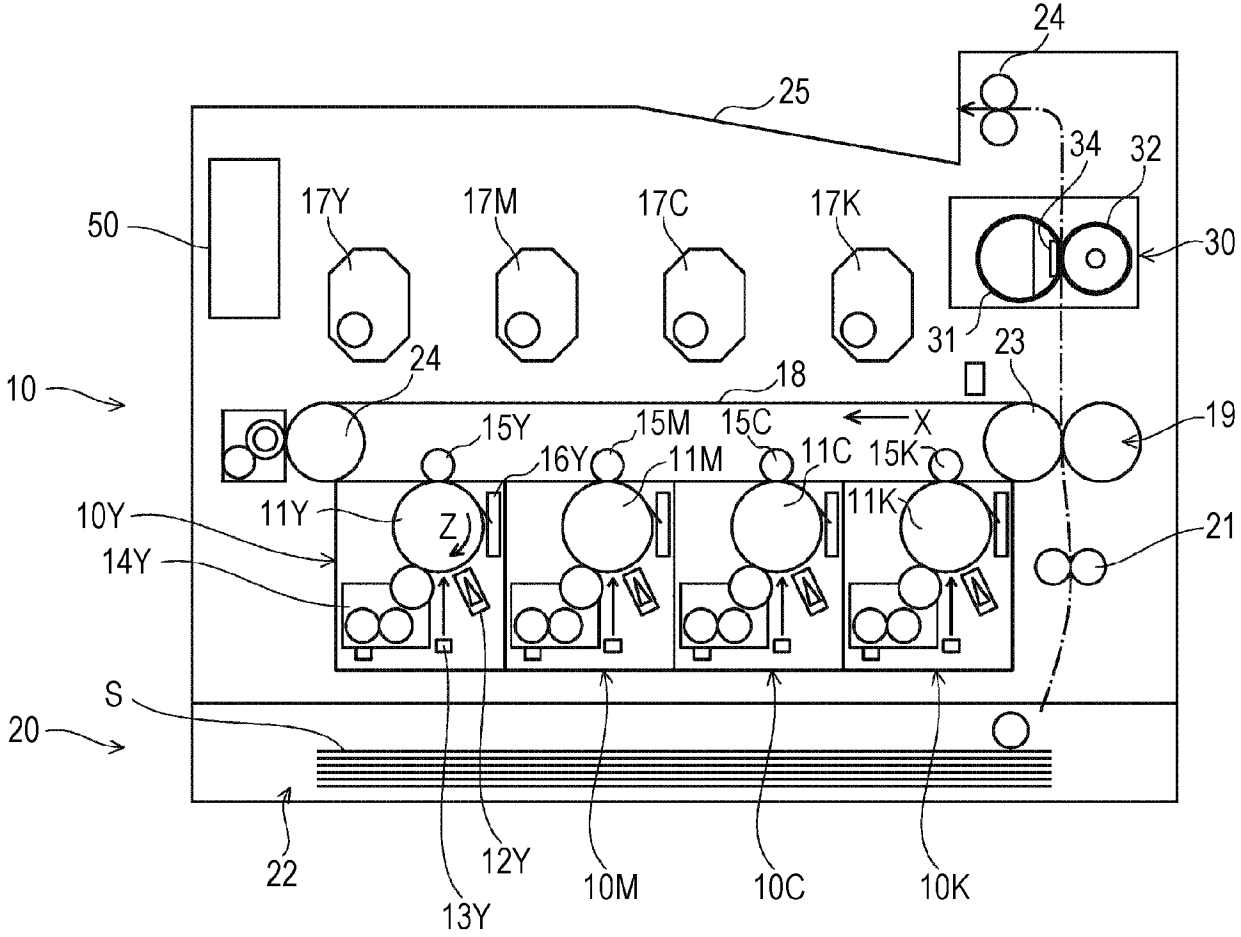
FIG. 1 is a schematic view illustrating a configuration of a tandem color printer as an example of an image forming apparatus according to an embodiment of the present invention.

FIG. 1 is a schematic view illustrating a configuration of a printer 1.

The printer 1 forms a full-color or monochrome image on a recording sheet such as plain paper and cardboard, based on image data and the like input from an external terminal device or others via a network (such as LAN), by using a known electrographic system.

The printer 1 includes an image forming unit 10 which forms a toner image on a recording sheet by using toner in colors of yellow (Y), magenta (M), cyan (C), and black (K), a feed unit 20 which feeds recording sheets to the image forming unit 10, a fixing device 30, a control unit 50 and other components.

The feed unit 20 includes a feed cassette 22 which accommodates recording sheets S, and supplies the recording sheets S sheet by sheet from the feed cassette 22 to the image forming unit 10.

The image forming unit 10 includes an intermediate transfer belt 18 located substantially at the center of the printer 1, and extended in the horizontal direction between a pair of rollers 23 and 24. The intermediate transfer belt 18 is circulated by a not-shown motor in a direction indicated by an arrow X.

Process units 10Y, 10M, 10C, and 10K are provided below the intermediate transfer belt 18. The process units 10Y, 10M, 10C, and 10K are disposed in this order in a rotation direction of a lower running part of the intermediate transfer belt 18. Each of the process units 10Y, 10M, 10C, and 10K forms a toner image on the intermediate transfer belt 18 using toner in the corresponding color of yellow, magenta, cyan, or black.

Toner storage units 17Y, 17M, 17C, and 17K are provided above the intermediate transfer belt 18 to supply toner to the process units 10Y, 10M, 10C, and 10K, respectively.

The respective process units 10Y, 10M, 10C, and 10K have the same configuration except for the use of different toner colors, wherefore only the configuration of the process unit 10Y is chiefly discussed herein without touching upon the detailed configurations of the other process units 10M, 10C, and 10K.

The process unit 10Y includes a photosensitive drum 11Y configured to rotate in a direction indicated by an arrow Z. The process unit 10Y further includes a charging unit 12Y disposed below the photosensitive drum 11Y and uniformly charging the surface of the photosensitive drum 11Y.

The process unit 10Y further includes an exposing device 13Y disposed on the downstream side in the rotation direction of the photosensitive drum 11Y with respect to the charging unit 12Y and located below the photosensitive drum 11Y in the vertical direction, and a developing unit 14Y disposed on the downstream side in the rotation direction of the photosensitive drum 11Y with respect to an exposure position of the surface of the photosensitive drum 11Y, i.e., a position subjected to exposure by the exposing device 13Y.

The exposing device 13Y forms an electrostatic latent image by applying laser beams to the surface of the photosensitive drum 11Y uniformly charged by the charging unit 12Y. The developing unit 14Y develops the electrostatic latent image formed on the surface of the photosensitive drum 11Y using toner in Y color.

A primary transfer roller 15Y is provided above the process unit 10Y in such a position as to face to the photosensitive drum 11Y with the lower running part of the intermediate transfer belt 18 interposed between the primary transfer roller 15Y and the photosensitive drum 11Y. The primary transfer roller 15Y generates an electric field between the primary transfer roller 15Y and the photosensitive drum 11Y when transfer bias voltage is applied to the primary transfer roller 15Y.

Primary transfer rollers 15M, 15C, and 15K are provided above the other process units 10M, 10C, and 10K, respectively, in such positions as to face to the corresponding photosensitive drums 11M, 11C, and 11K with the lower running part of the intermediate transfer belt 18 interposed between the primary transfer rollers 15M, 15C, and 15K and the photosensitive drums 11M, 11C, and 11K.

Respective toner images formed on the photosensitive drums 11Y, 11M, 11C, and 11K are transferred to the intermediate transfer belt 18 in primary transfer by the effect of electric fields generated between the primary transfer rollers 15Y, 15M, 15C, and 15K and the photosensitive drums 11Y, 11M, 11C, and 11K. The photosensitive drum 11Y after the primary transfer of the toner image is cleaned by a cleaning member 16Y.

In forming a full-color image, the respective images are formed by the process units 10Y, 10M, 10C, and 10K at different timing so that the respective toner images formed on the photosensitive drums 11Y, 11M, 11C, and 11K can be transferred to the same area of the intermediate transfer belt 18 for multilayer transfer.

On the other hand, in forming a monochrome image, only a selected unit (such as process unit 10K for K toner) is operated. In this case, a toner image is formed on the photosensitive drum (such as photosensitive drum 11K) of the corresponding process unit. The toner image thus formed is transferred to a predetermined area of the intermediate transfer belt 18 by the primary transfer roller (such as primary transfer roller 15K) disposed opposed to the corresponding process unit.

The part of the intermediate transfer belt 18 to which the toner image is transferred shifts to a secondary transfer position facing to a secondary transfer roller 19 in accordance with circulation of the intermediate transfer belt 18.

The recording sheet S drawn from the feed cassette 22 of the feed unit 20 is conveyed by a pair of resist rollers 21 at appropriate timing to a transfer nip formed by the secondary transfer roller 19 and the intermediate transfer belt 18. At the transfer nip, the toner image transferred to the intermediate transfer belt 18 is further transferred to the recording sheet S for secondary transfer by the effect of an electric field generated between the secondary transfer roller 19 and the intermediate transfer belt 18.

The recording sheet S having passed through the transfer nip is conveyed to the fixing device 30 disposed above the secondary transfer roller 19. At the fixing device 30, the toner image is fixed to the recording sheet S by heat and pressure applied to the toner image. The recording sheet S to which the toner image has been fixed is discharged by discharge rollers 24 onto a discharge tray 25.

(2) Configuration of Fixing Device

Figure 2:
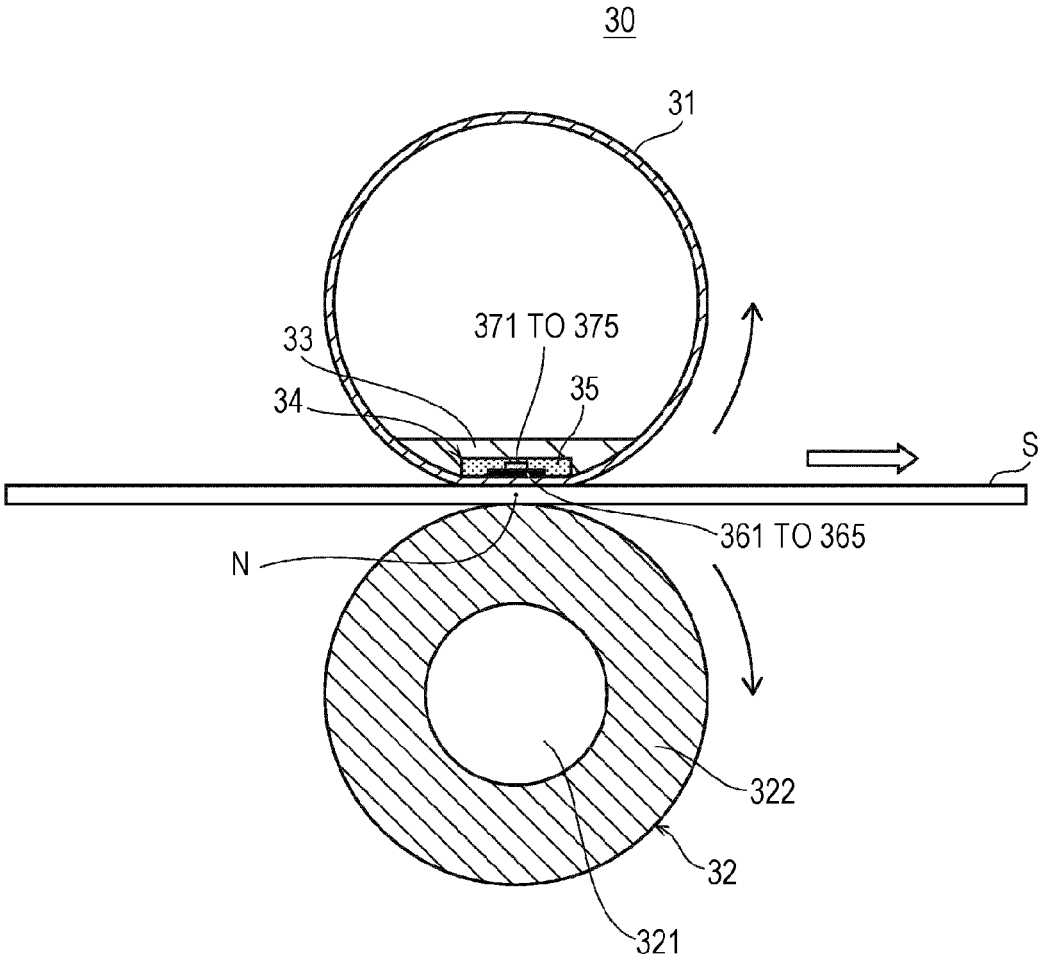
FIG. 2 is a cross-sectional view illustrating a configuration of a fixing device included in the printer.

FIG. 2 is a cross-sectional view illustrating a configuration of a main part of the fixing device 30. FIG. 2 illustrates a condition of the fixing device 30 rotated through 90 degrees from the condition in FIG. 1 for the sake of convenience.

As illustrated in FIG. 2, the fixing device 30 adopts a so-called film-heating system. According to this system, a thermal head 34 supported on a support member 33 is disposed on an inner surface of a cylindrical fixing belt 31 functioning as a fixing rotating body. A pressure roller 32 is pressed against the fixing belt 31 at a portion corresponding to the thermal head 34 to form a fixing nip portion N. This system shortens the warmup time by reducing the heat capacity of the fixing device 30.

The thickness of the fixing belt 31 is approximately 300 μm, and constituted by a single-layer film made of resin such as PTFE, PFA, and PPS, or composite film layers containing a film such as polyimide, polyamide imide, PEEK, and PES whose film surface is coated with PTFE, PFA, PEP or the like as a releasable flat layer.

Both ends of the fixing belt 31 in the longitudinal direction thereof are supported by cap-shaped guide members (not shown) in a manner slidable in the rotation direction of the fixing belt 31. Both ends of the support member 33 of the thermal head 34 in the longitudinal direction thereof are fixed to the cap-shaped guide members in a manner not rotatable in accordance with the rotation of the fixing belt 31.

The pressure roller 32 is constituted by a core member 321 made of metal such as aluminum, and an elastic layer 322 made of material having excellent heat resistance property, thermal insulation property, and durability, such as silicon rubber, and formed around the core member 321.

The thermal head 34 is divided into a plurality of heating areas in a main scanning direction of the fixing belt 31 so that the respective areas can be individually heated.

Figure 3:
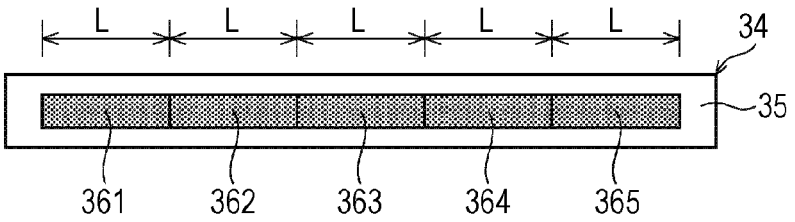
FIG. 3 is a plan view of a thermal head included in the fixing device as viewed from the side where resistance heating elements are provided.

FIG. 3 is a plan view of the thermal head 34 in FIG. 2 as viewed from below. As illustrated in FIG. 3, resistance heating elements 361 to 365 as independent heating units are provided on a long substrate 35 extended in the main scanning direction with an equal pitch L. Power is individually supplied to the respective resistance heating elements 361 to 365 via a not-shown wiring pattern formed on the substrate 35.

It is preferable that a portion of the thermal head 34 in contact with the circumferential surface of the fixing belt 31 is coated with material having excellent heat resistance property and abrasion resistance property, such as heat-resistant glass, for increasing durability of the thermal head 34. It is allowed that heat-resistant grease is further applied between the thermal head 34 and the fixing belt 31 to improve durability.

The substrate 35 is made of material having heat resistance property and insulation property, such as alumina and aluminum nitride. The support member 33 is made of material having heat resistance property and thermal insulation property (such as ceramics).

Temperature sensors 371 to 375 such as thermistors (see FIG. 2) are provided on the substrate 35 at positions facing to the respective resistance heating elements 361 to 365. The temperature sensors 371 to 375 detect temperatures of the corresponding resistance heating elements 361 to 365, and notify the control unit 50 about the detected temperatures.

The pressure roller 32 is rotated in a direction of an arrow by a not-shown drive source. The fixing belt 31 rotates in accordance with the rotation of the pressure roller 32.

(3) Configuration of Control Unit

Figure 4:
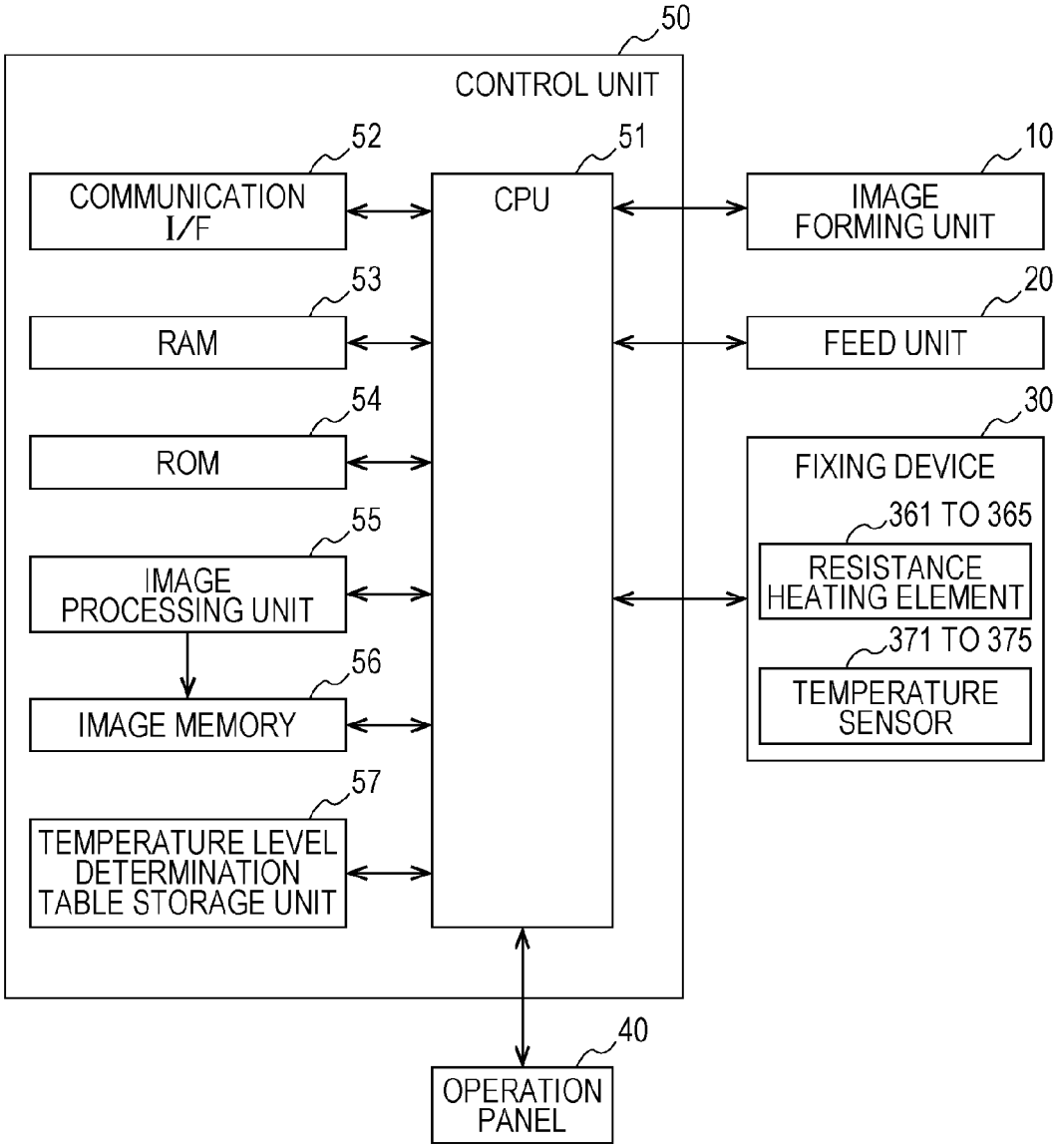
FIG. 4 is a block diagram illustrating a configuration of a control unit included in the printer.

FIG. 4 is a block diagram illustrating a main configuration of the control unit 50.

As illustrated in this figure, the control unit 50 includes a CPU (Central Processing Unit) 51, a communication I/F (interface) 52, a RAM (Random Access Memory) 53, a ROM (Read Only Memory) 54, an image processing unit 55, an image memory 56, and a temperature level determination table storage unit 57.

The CPU 51 reads a control program from the ROM 54 at the time of power supply to the printer 1, for example, and executes this control program using a work memory area provided by the RAM 53.

The CPU 51 also receives a print job from the communication I/F 52 as a job transmitted from another terminal via a communication network such as a LAN.

Image data on R, G, and B given as a part of data contained in the print job received from the external terminal is converted by the image processing unit 55 into concentration data on development colors of cyan, magenta, yellow, and black. The image data is also subjected to known image processing such as edge enhancement and smoothing, and stored into the image memory 56.

The temperature level determination table storage unit 57 stores temperature level determination tables (see FIG. 7) referred to at the time of control of the respective temperatures of the resistance heating elements 361 to 365 of the fixing device 30 for fixation.

Based on the temperature level determination tables stored in the temperature level determination table storage unit 57, the temperatures of the resistance heating elements 361 to 365 are adjusted to temperatures defined by corresponding temperature levels with reference to detection results obtained by the temperature sensors 371 to 375 (hereinafter referred to as "fixing temperature control"). This control will be detailed later.

The CPU 51 controls respective operations of the image forming unit 10, the feed unit 20, and the fixing device 30 based the data contained in the print job received from the external terminal device via the communication I/F 52 to smoothly execute print operation.

(4) Fixing Temperature Control

Discussed hereinbelow are the details of the fixing temperature control executed by the control unit 50.

(4-1) Outline of Fixing Temperature Control

Figure 5:
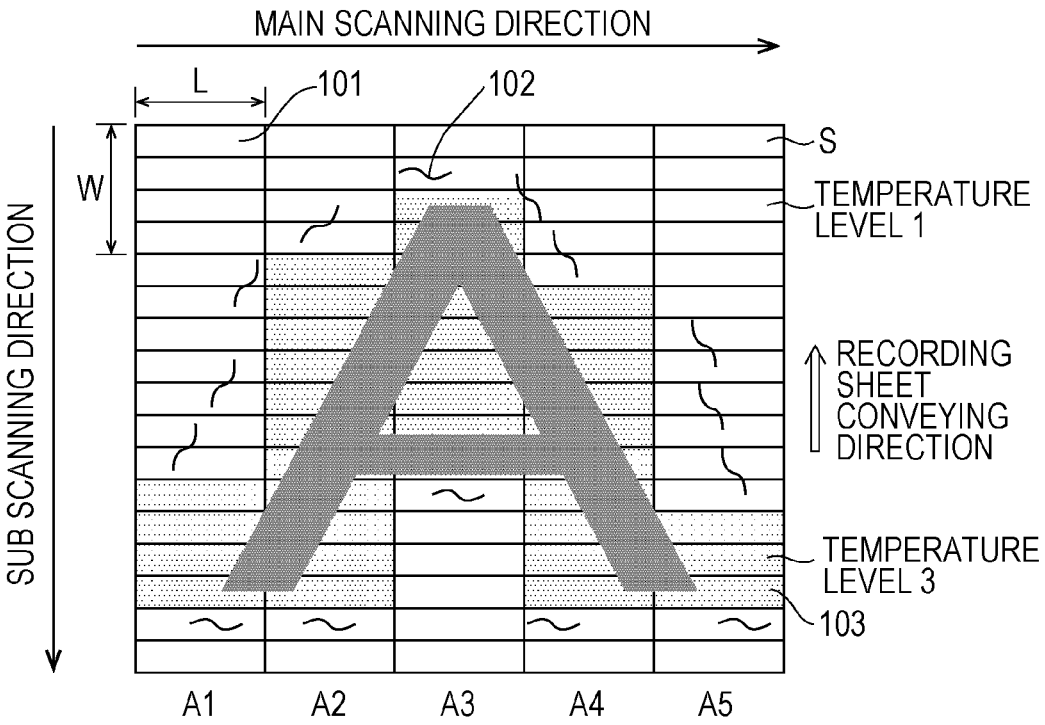
FIG. 5 is a view illustrating crinkling of a recording sheet caused by temperature control performed by a conventional fixing device.

FIG. 5 is a schematic view illustrating the outline of conventional fixing temperature control. This figure shows a large character "A" formed on the recording sheet S by way of example.

Initially, each of heating areas A1 to A5 on the recording sheet S, as areas divided in the main scanning direction in correspondence with the resistance heating elements 361 to 365, is further divided in a sub scanning direction into a plurality of heating division areas 101 each having a width W.

Then, the presence or absence of a toner image is determined for each of the heating division areas. Based on this determination, the resistance heating elements 361 to 365 are controlled such that the temperatures of the resistance heating elements 361 to 365 corresponding to heating division areas 103 (portions of dark gray blocks in FIG. 5) where the toner image is present are adjusted to temperature level 3 (temperature necessary for fixation of toner, such as 160° C.), and that the temperatures of the resistance heating elements 361 to 365 corresponding to the heating division areas 101 (portions of white blocks in FIG. 5) where the toner image is absent are adjusted to temperature level 1 (such as 100° C.) corresponding to a temperature considerably lower than temperature level 3.

By this temperature control, the toner image is securely fixed by heat, and the power consumption is reduced as a result of decrease in the temperatures of the portions not requiring fixation.

However, when the temperature rising speed is increased by reduction of the heat capacities of the fixing belt 31 and others in contact with the thermal head 34 for the purpose of further reduction of the power consumption, crinkles 102 are produced at a temperature rising speed of about 20° C./sec., in the vicinity of the boundary between the heating division areas 101 set to temperature level 1 and the heating division areas 103 set to temperature level 3, according to findings of the present inventors.

It is considered that these crinkles 102 are produced by partial increase in internal stress in the recording sheet S caused by a remarkable local difference in the thermal expansion amount and the moisture evaporation amount of the recording sheet between temperature level 1 and temperature level 3, under the condition of an extremely short distance of change from temperature level 1 to temperature level 3, or from temperature level 3 to temperature level 1 on the recording sheet S, as a result of excessive increase in the temperature rising speed and the temperature lowering speed in accordance with reduction of the heat capacities of the fixing belt 31 or others.

Figure 6:
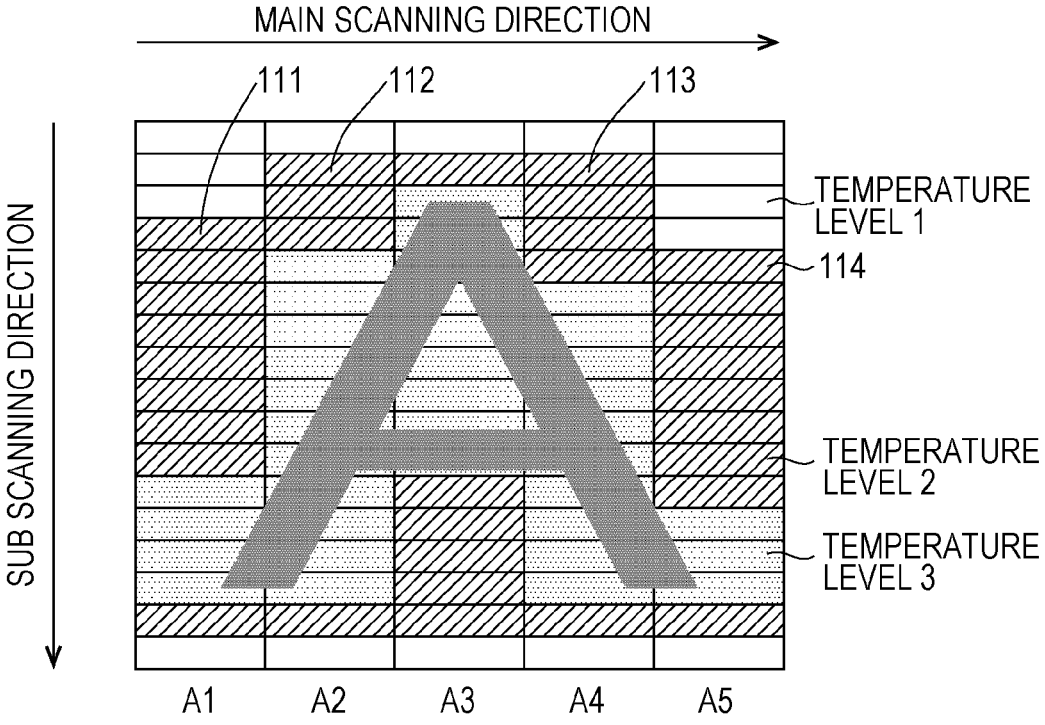
FIG. 6 is a view illustrating reduction of crinkling of the recording sheet achieved by temperature control by the fixing device according to the embodiment of the present invention.

Accordingly, as illustrated in a schematic view in FIG. 6, the present inventors provide additional heating division areas (hatched portions in FIG. 6) as areas to be adjusted to a target temperature of temperature level 2 (such as control target temperature of 130° C.) between the heating division areas whose control target temperature is set to temperature level 3 and the heating division areas whose control target temperature is set to temperature level 1 so as to prevent temperature change amount per unit distance on the recording sheet S to avoid generation of the crinkles 102.

For realizing this configuration, temperature level determination tables, an example of which is illustrated in FIG. 7, are created beforehand based on analysis of image data on an image to be formed on the recording sheet S, so that temperature control can be performed for the respective resistance heating elements 361 to 365 based on the created tables.

In the temperature level determination table illustrated in FIG. 7, an "M column" on the uppermost column shows the order of the divided areas (A1 to A5) from the left in the main scanning direction in FIG. 6, while an "N column" on the leftmost row shows the order of the heating division areas from the leading end of the recording sheet S in the conveying direction.

In the following description, it is assumed that a heating division area (M, N) is located in the Mth column ($1 \leq M \leq 5$) from the left, and in the Nth column ($1 \leq N \leq Nmax$, Nmax is the smallest integer equal to or larger than a value calculated by dividing the length of the recording sheet S in the sub scanning direction by the width W of the heating division area in the sub scanning direction) from the leading end.

For example, the temperature level of the heating section area (3, 2) is "2" based on the table illustrated in FIG. 7.

(4-2) Flowchart

Figure 8:
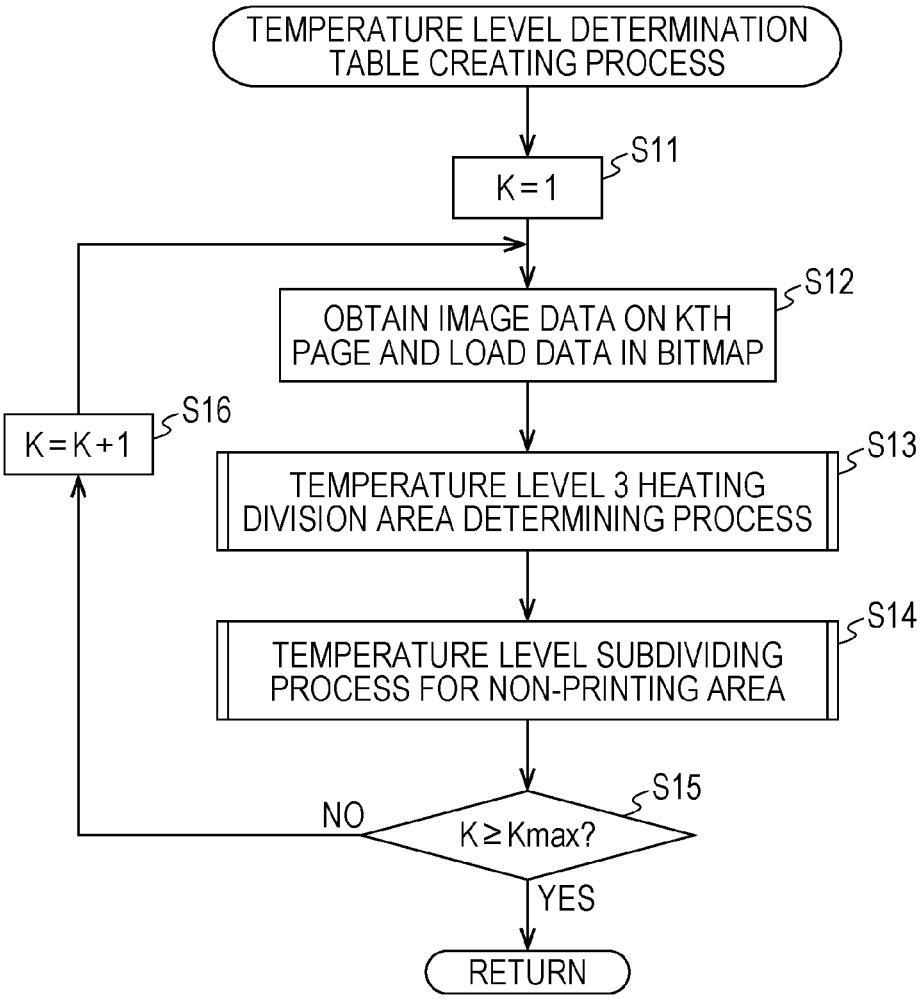
FIG. 8 is a flowchart describing the contents of a temperature level determination table creating process executed by the control unit.

FIG. 8 is a flowchart describing an example of a temperature level determination table creating process executed by the CPU 51 of the control unit 50. This process is executed as a sub routine of a not-shown main flowchart for controlling the general operation of the printer 1.

Initially, the CPU 51 sets a counter value K indicating the page number to 1 (step S11), and obtains image data on the Kth page from the image memory 56 to load the data in bitmap for each of the development colors of cyan, magenta, yellow, and black (step S12).

The counter value K is stored in the RAM 53. The image data loaded in bitmap is stored in the RAM 53 or another storage area within the image memory 56.

It is determined whether an image (image to which toner is applied) contained in the memory of the image data loaded in bitmap is present or absent within the storage area corresponding to each of the heating division areas. Based on this determination, a subsequent process is executed for determining whether or not a control target temperature to be set for the corresponding heating division area 101 is temperature level 3 (step S13) (temperature level 3 heating division area determining process).

Figure 9:
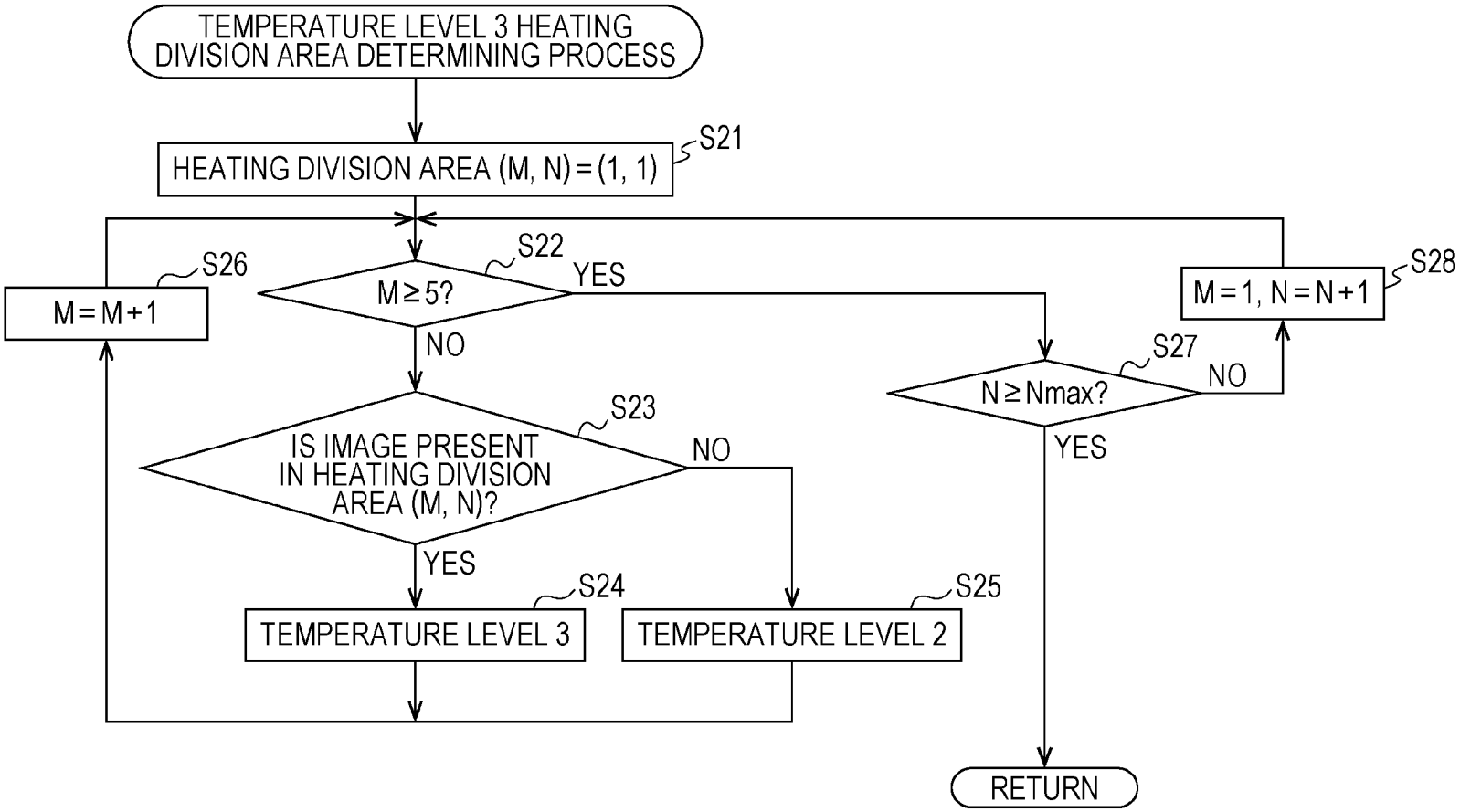
FIG. 9 is a flowchart describing the contents of a sub routine of a temperature level 3 heating division area determining process executed in step S13 in FIG. 8.

FIG. 9 is a flowchart describing a sub routine of the temperature level 3 heating division area determining process.

Initially, both values of M and N of the heating division area (M, N) are set to 1 (step S21).

In the subsequent step, whether or not M is 5 or larger is determined (step S22). In this example, M=1 is determined (step S22: No), wherefore the flow proceeds to step S23. In step S23, it is determined whether or not an image is present in the heating division area (M, N).

More specifically, in case of printing of a monochrome image, search is conducted within a memory address corresponding to the heating division area (M, N) in the memory which stores bitmap data on black of the Kth page. When image data indicating image formation is present, it is determined that the image is "present". In case of a color image, search is similarly conducted for the memories of bit map data on yellow, cyan, and magenta. When image data at least on one color is present, "Yes" is determined in step S23. When the pixel number of the image data indicating image formation is smaller than a predetermined proportion (such as 1%) of the total pixel number of the corresponding heating division area, it is considered that considerable deterioration is not caused even when fixation is made at the temperature of temperature level 2. In this case, "No" may be determined with priority given to power saving.

When it is determined that the image is present within the heating division area (M, N) in step S23, this area is a printing area (image forming area) (step S23: Yes). Accordingly, the temperature level of this area is determined as "temperature level 3" (step S24). When it is determined that the image is absent, this area is a non-printing area (non-image forming area) (step S23: No). Accordingly, the temperature level of this area is determined as "temperature level 2" (step S25). The determined temperature level is registered at the position of (M, N) of the temperature level determination table (FIG. 7).

After incrementing the value M (step S26), the flow returns to step S22. In step S22, it is determined whether or not M is 5 or larger. When it is determined that M is smaller than 5 (step S22: No), the processes from S23 to S26 are repeated. When it is determined that M is 5 or larger (step S22: Yes), the flow shifts to step S27 to determine whether or not N is Nmax or larger. When it is determined that N is smaller than Nmax (step S27: No), it is considered that there remain other heating division areas (M, N) for which the temperature level is to be determined. In this case, M=1 and N=N+1 are set in step S28, and the flow returns to step S22. Thereafter, the processes from S23 to S25 are executed to determine the temperature level of the heating division area in the subsequent column.

As described above, the value "Nmax" is calculated based on the length of the recording sheet S in the conveying direction, and the width W of the heating division area in the sub scanning direction. The values of Nmax in accordance with the sizes of the recording sheets have been stored as a table in the ROM 54 beforehand. The CPU 51 obtains the value Nmax in the corresponding size from the ROM 54 based on information on the recording sheet size described in a header of a received print job.

When N≥Nmax is determined in step S27 (step S27: Yes), it is considered that settings of temperature levels 3 and 2 have been completed for all the heating division areas (M, N). Accordingly, the flow returns to the flowchart in FIG. 8 to execute a process for subdividing the temperature level of the non-printing area (heating division area determined as temperature level 2 in step S25 in FIG. 9) in step S14 of the flowchart in FIG. 8.

Figure 10:
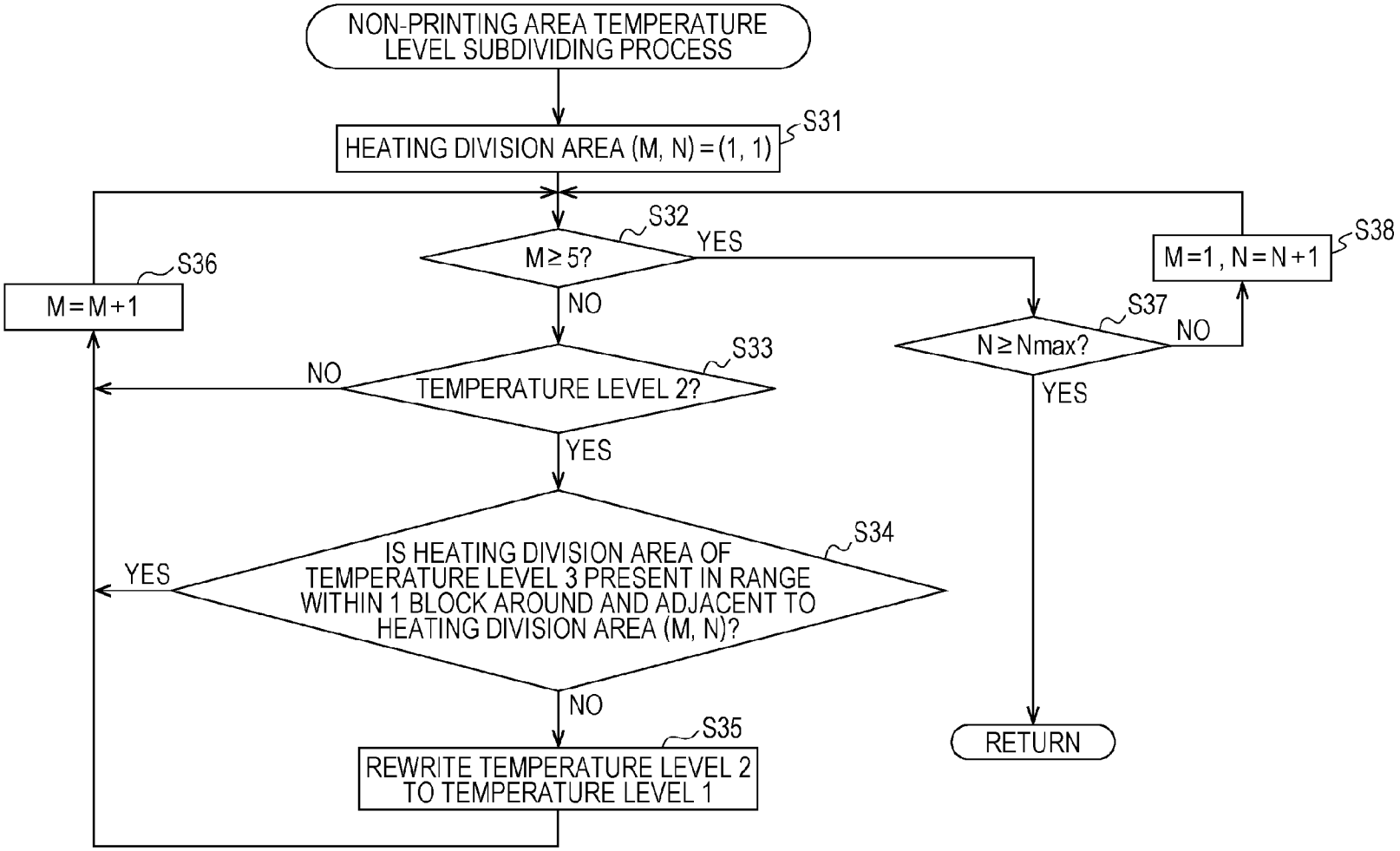
FIG. 10 is a flowchart describing the contents of a sub routine of a temperature level subdividing process for a non-printing area executed in step S14 in FIG. 8.

FIG. 10 is a flowchart describing the contents of a sub routine of a non-printing area temperature level subdividing process.

Initially, both values of M and N of the heating division area (M, N) are set to 1 (step S31). In the subsequent step, whether or not M is 5 or larger is determined (step S32). The current value M is 1 in this example (step S32: No), the flow proceeds to step S33 to determine whether or not the corresponding heating division area (M, N) is set to temperature level 2 with reference to the temperature level determination table.

When it is determined that temperature level 2 has not been set (step S33: No), it is considered that temperature level 3 has been set. Accordingly, the value M is incremented without the necessity of subdivision (step S36), whereupon the flow returns to step S32.

When it is determined that temperature level 2 has been set (step S33: Yes), it is determined whether or not there exists a heating division area set to temperature level 3 in a range around and adjacent to the corresponding heating division area (M, N) within one block from the heating division area (M, N) (step S34). The "one block" in this context refers to one unit of the heating division area.

When there exists a heating division area set to temperature level 3 within the range of one block around the heating division area (M, N) (step S34: Yes), the temperature level of the heating division area (M, N) as the determination target is kept at temperature level 2 to avoid a rapid temperature change. Accordingly, the value M is incremented without changing the temperature level (step S36), and the flow returns to step S32.

On the other hand, when there exists no heating division area set to temperature level 3 within the range of one block around the heating division area (step S34: No), it is considered that the surroundings are all set to temperature level 2 or lower. In this case, the temperature does not rapidly change when temperature level 1 is set. Accordingly, temperature level 2 of the corresponding heating division area (M, N) is rewritten to temperature level 1 (step S35), whereafter the value M is incremented (step S36). Then, the flow returns to step S32.

In step S32, it is determined whether or not M is 5 or larger. When it is determined that M is smaller than 5 (step S32: No), the processes from step S33 to step S35 are repeated. When it is determined that M is 5 or larger (step S32: Yes), the flow shifts to step S37 to determine whether or not N is Nmax or larger. When it is determined that N is smaller than Nmax (step S37: No), it is considered that there remain other heating division areas (M, N) for which the temperature level subdivision is to be determined. In this case, M=1 and N=N+1 are set in step S38, and the flow returns to step S32. Thereafter, the processes from S33 to S35 are executed to complete the temperature level subdividing process for the heating division area in the subsequent column.

When N≥Nmax is determined in step S37 (step S37: Yes), it is considered that settings of the temperature levels have been completed for all the heating division areas (M, N). Accordingly, the flow returns to the flowchart in FIG. 8.

In step S15, it is determined whether or not the counter value K indicating the page number is Kmax.

The value Kmax indicates the number of pages for printing performed in accordance with the received print job, and is obtained from information included in the header of the received print job.

When the value K is not Kmax, the value K is incremented (step S16). Thereafter, the processes from step S11 to step S14 are repeated to create the temperature level determination table for the next page.

When K≥Kmax is determined in step S15 (step S15: Yes), it is considered that the temperature level determination tables have been created for all the pages of the received print job. Accordingly, the temperature level determination table creating process ends, whereupon the flow returns to the not-shown main flowchart.

The temperature level determination tables thus created are stored in the temperature level determination table storage unit 57 in association with the page numbers.

When image data for all pages of the print job is loaded in bitmap at a time at the start of operation to create the temperature level determination tables, the memory capacity needed for storing this data becomes large. Accordingly, the temperature level determination table may be created page by page in time for printing of the corresponding page in accordance with progress in printing.

The CPU 51 reads image data on the page for forming the subsequent image, and also simultaneously reads the temperature level determination table for the corresponding page from the temperature level determination table storage unit 57 to execute printing operation and a fixing process.

More specifically, the CPU 51 controls power supply to the resistance heating elements 361 to 365 with reference to the detection results obtained from the temperature sensors 371 to 375 such that each of the temperature of the heating division areas (M, N) of the recording sheet can be maintained at the temperature level of the temperature level determination table with reference to the read temperature level determination table (see FIG. 7) while the corresponding heating division area (M, N) is passing through the fixing nip portion.

The time when each of the heating division areas (M, N) reaches the fixing nip is recognized based on the conveying speed of the recording sheet, and an elapsed time from a predetermined reference time (such as driving start time of the pair of resist rollers).

In this case, it is needed that the temperatures of the resistance heating elements 361 to 365 corresponding to at least the heating division areas set to temperature level 3 for each of the heating areas A1 to A5 of the recording sheet S reach temperature level 3 (160° C.) before the corresponding heating division areas arrive at the fixing nip portion. Accordingly, it is needed that the control target temperature of the heating division areas set to temperature level 2 (130° C.) and located immediately before the heating division areas set to temperature level 3 is raised to 160° C. while these heating division areas at temperature level 2 are passing through the fixing nip portion. This control target temperature is switched to 130° C. corresponding to temperature level 2 immediately after the heating division areas set to temperature level 3 in the recording sheet S pass through the fixing nip portion.

The width W in the sub scanning direction is determined such that the foregoing fixing temperature control can be realized in consideration of the heating capability of the resistance heating elements 361 to 365, the system speed of the printer 1, the specific temperature difference between temperature levels 2 and 3, and other conditions. When the width W is excessively short, there is a possibility that the control target temperature of the heating division area is set to temperature level 3 while the heating division area set to temperature level 1 is passing through the fixing nip portion prior to entrance of the heating division area set to temperature level 2 into the fixing nip portion. In this case, the presence of the intermediate temperature range of temperature level 2 between temperature level 3 and temperature level 1 does not sufficiently offer advantages.

According to the fixing process executed in this embodiment, each of the heating areas A1 to A5 divided in the main scanning direction is further divided into the heating division areas (M, N). It is determined whether or not each of the heating division areas (M, N) is a printing area. For the printing area, temperature level 3 is set. For the other heating division areas, the temperatures are so controlled as to drop to intermediate temperature level 2, and further to temperature level 1. This method prevents excessive increase in temperature change amount per unit distance along the recording sheet surface of the recording sheet after fixation. Accordingly, this method avoids crinkling of the recording sheet caused by generation of large tension in the sheet surface of the recording sheet even at a higher temperature rising speed. Moreover, the control target temperature of the areas other than the printing area is set to a low temperature, wherefore power saving is achievable.

MODIFIED EXAMPLE

While the foregoing embodiment has been described as an example of the present invention, the scope of the present invention is not limited to this specific embodiment in any way. For example, the following modifications may be made.

Figure 11A:
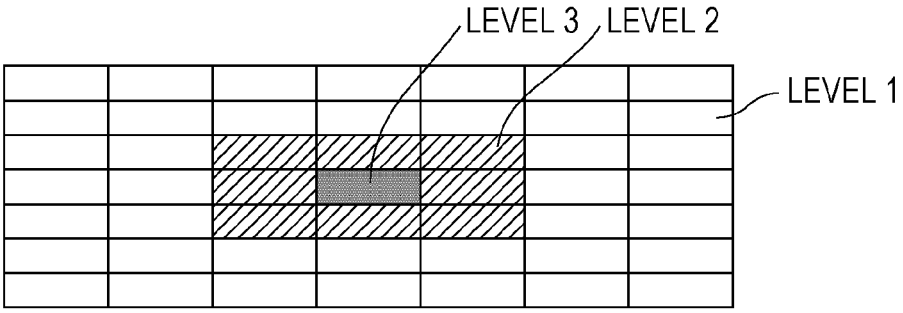
FIG. 11A illustrates a temperature level dividing method for a non-printing area according to the embodiment.

(1) According to this embodiment, temperature level 2 is set only for the heating division areas around and adjacent to the heating division area set to temperature level 3 within one block from the heating division area set to temperature level 3 as illustrated in FIG. 11A.

However, on such occasions when the recording sheet is constituted by cardboard, when the image concentration is high for each of the printing areas, and when the necessary toner amount per unit area is large due to a large printing area within each heating division area or for other reasons, for example, it is preferable that the control target temperature of temperature level 3 for the printing area is raised for the purpose of improvement of fixation.

Figure 11B:
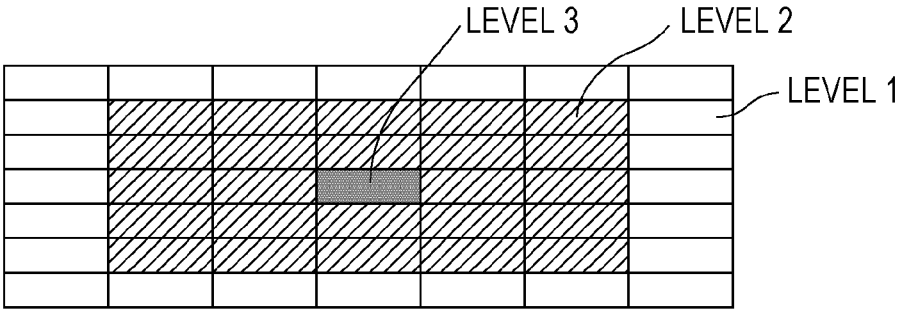
FIGS. 11B and 11C illustrate modified examples of the temperature level dividing method for a non-printing area.
Figure 11C:
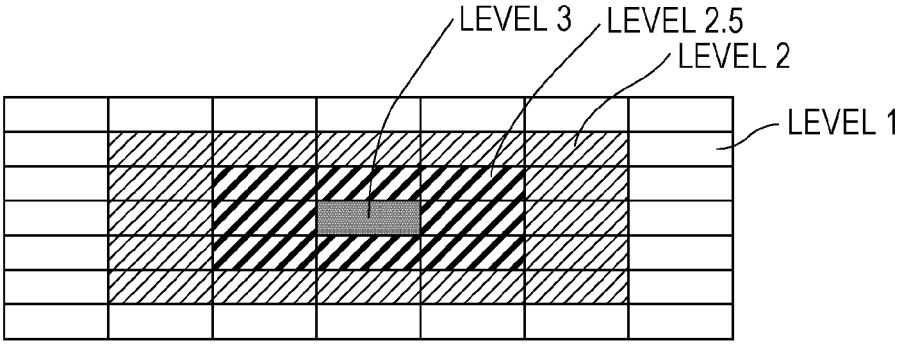

In case of a device of a type capable of raising the target fixing temperature in accordance with various image forming conditions, the range of the area set to temperature level 2 around temperature level 3 is widened to 2 blocks around the heating division area of temperature level 3 as illustrated in FIG. 11B, or heating division areas of temperature level 2.5 as an intermediate target temperature level between temperature level 3 and temperature level 2 are defined between the heating division areas of temperature level 3 and the heating division areas of temperature level 2 to increase the number of levels of the target temperature as illustrated in FIG. 11C. These structures can more securely prevent a local rapid temperature change of the recording sheet.

Figure 12:
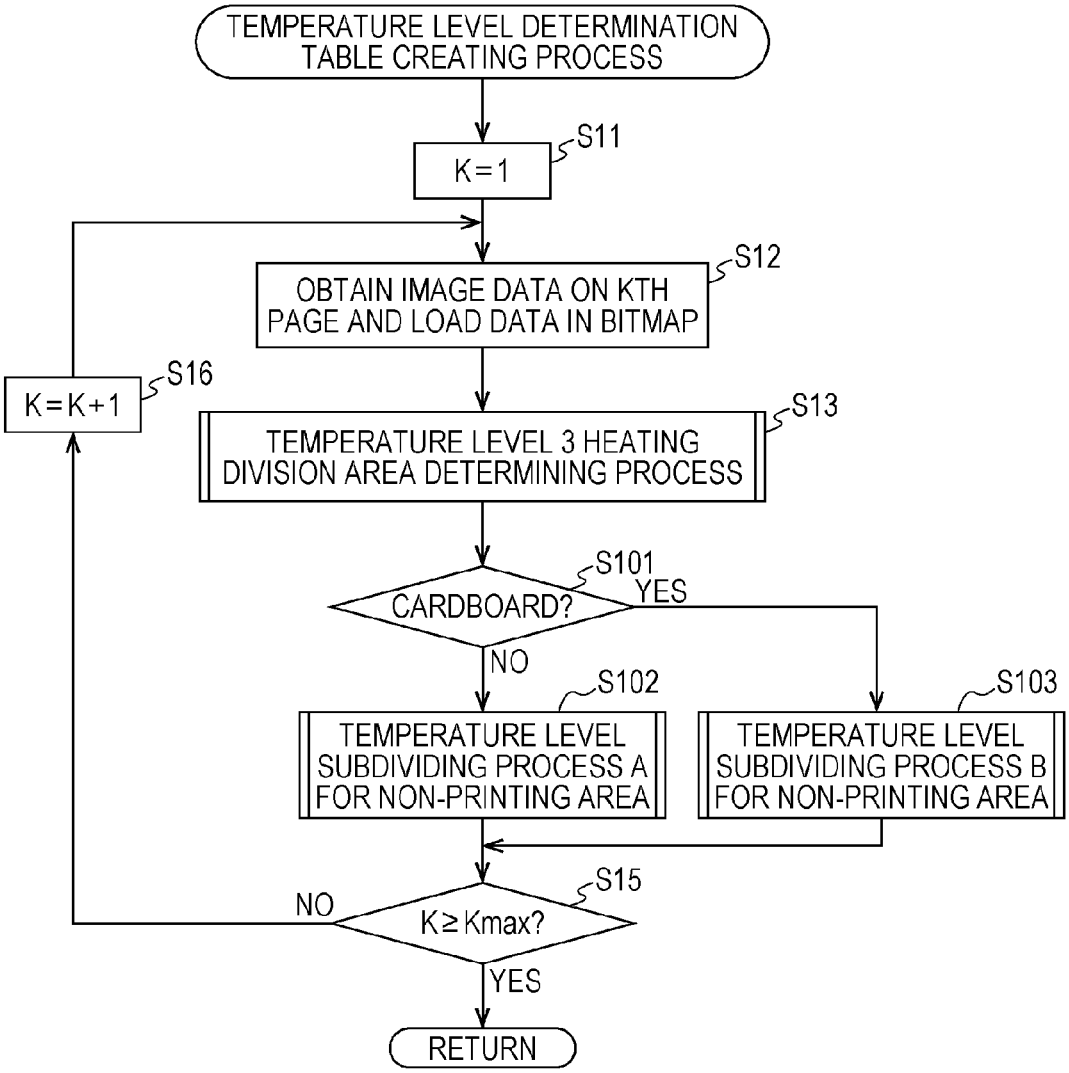
FIG. 12 is a flowchart describing the contents of a temperature level determination table creating process according to a modified example.
Figure 13:
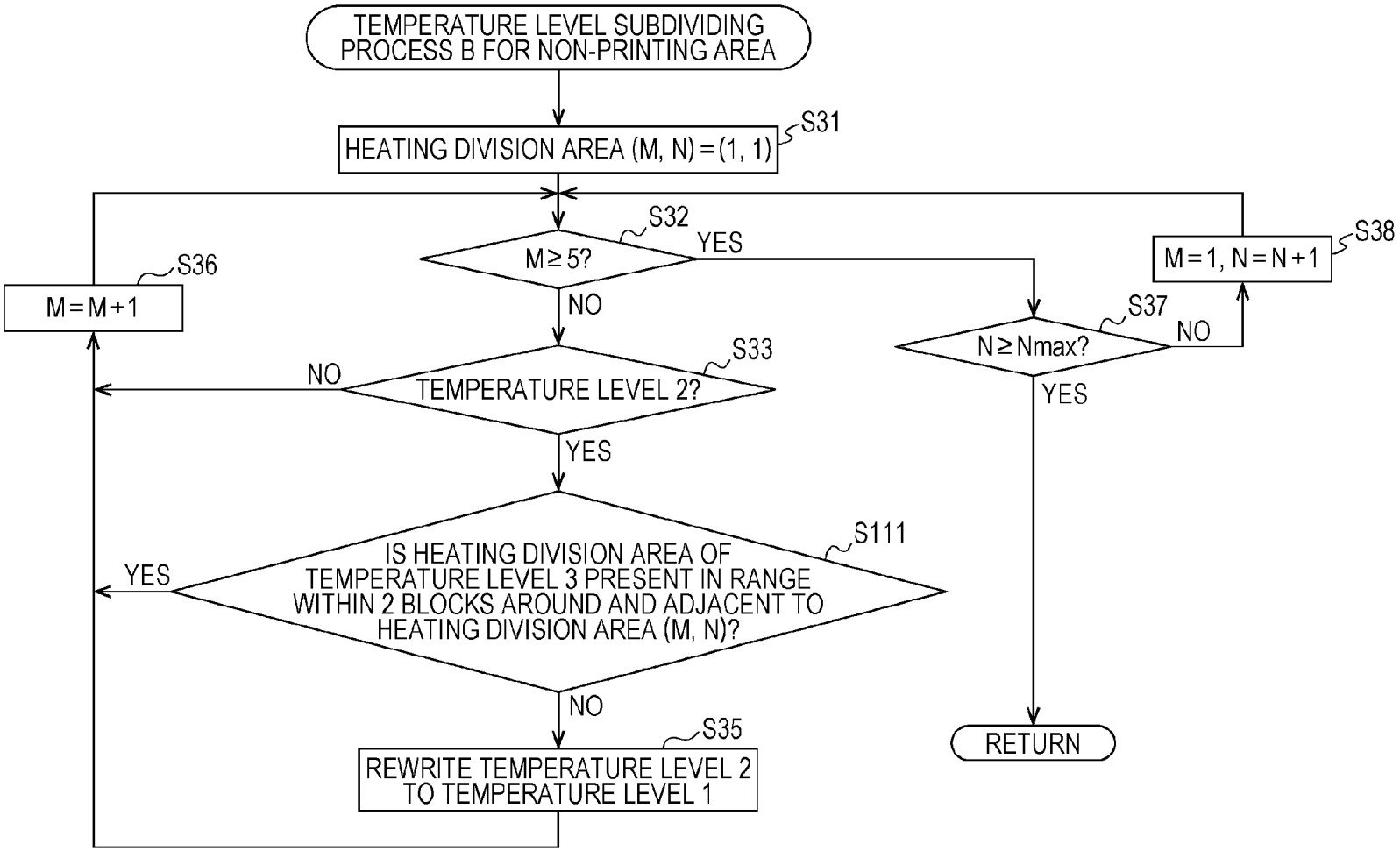
FIG. 13 is a flowchart describing the contents of a sub routine of a temperature level subdividing process B for a non-printing area executed in step S103 in FIG. 12.

FIGS. 12 and 13 are flowcharts showing an example of such control, describing a temperature level determination table creating process for widening the area corresponding to temperature level 2 as illustrated in FIG. 11B, executed when the target fixing temperature is to be raised for handling the recording sheet constituted by cardboard. In the respective flowcharts shown in FIGS. 12 and 13, steps similar to the corresponding steps performed in the embodiment in FIGS. 8 and 9 as processes indicating similar contents have been given similar step numbers so as to simplify the description of the respective flowcharts in FIGS. 12 and 13.

FIG. 12 is a flowchart of a temperature level determination table creating process according to a modified example, and is different from FIG. 8 in processes from step S101 to step S103.

The CPU 51 sets the counter value K indicating the page number to 1 (step S11), obtains image data on the Kth page from the image memory 56, and loads the image data in bitmap for each of the development colors in cyan, magenta, yellow, and black (step S12).

Based on the loaded image data in bitmap, a process for determining whether or not the control target temperature for a corresponding heating division area is temperature level 3 (temperature level 3 heating division area determining process) is executed (step S13).

This flowchart describing a subroutine of the temperature level 3 heating division area determining process is similar to the corresponding flowchart in FIG. 9.

In step S101, it is determined whether or not the recording sheet for printing is cardboard. According to this example, a user of the printer 1 registers the type of recording sheet stored in a feed cassette through an operation panel 40, wherefore whether or not the recording sheet is cardboard is determined based on this registration.

When it is determined that the recording sheet is not cardboard in step S101 (step S101: No), the flow proceeds to step S102 where a temperature level subdividing process A is executed for a non-printing area. When it is determined that the recording sheet is cardboard (step S101: Yes), the flow proceeds to step S103 where a temperature level subdividing process B is executed for a non-printing area.

In executing the temperature level subdividing process A for a non-printing area in step S102 based on the determination that the recording sheet is not cardboard and therefore handled in the same conditions as those in the foregoing embodiment, the flowchart shown in FIG. 10 is applicable as it is. Accordingly, only the details of the temperature level subdividing process B for a non-printing area in step S103 are discussed herein with reference to FIG. 13.

Both values of M and N of the heating division area (M, N) are initially set to 1 (step S31). In the subsequent step, whether or not M is 5 or larger is determined (step S32). The current value M is 1 in this example (step S32: No), the flow proceeds to step S33 to determine whether or not the corresponding heating division area (M, N) is set to temperature level 2 with reference to the temperature level determination table.

When it is determined that temperature level 2 has not been set (step S33: No), it is considered that temperature level 3 has been set. Accordingly, the value M is incremented without the necessity of subdivision (step S36), whereupon the flow returns to step S32.

When it is determined that temperature level 2 has been set (step S33: Yes), it is determined whether or not there exists a heating division area set to temperature level 3 in a range around and adjacent to the corresponding heating division area (M, N) within two blocks from the heating division area (M, N) (step S111).

When there exists a heating division area set to temperature level 3 within the range of two blocks around the heating division area (M, N) (step S111: Yes), the temperature level of the heating division area (M, N) as the determination target is kept at temperature level 2. In this case, the value M is incremented without changing the temperature level (step S36), whereupon the flow returns to step S32.

On the other hand, when there exists no heating division area set to temperature level 3 within the range of two blocks around the heating division area (M, N) (step S111: No), it is considered that the areas within the two blocks around the heating division area (M, N) are all set to temperature level 2 or lower. In this case, the temperature does not rapidly change when temperature level 1 is set. Accordingly, temperature level 2 of the corresponding heating division area (M, N) is rewritten to temperature level 1 (step S35). After the change of temperature level, the value M is incremented (step S36), whereupon the flow returns to step S32.

In step S32, it is determined whether or not M is 5 or larger. When it is determined that M is smaller than 5 (step S32: No), the processes from step S33 to step S35 are repeated. When it is determined that M is 5 or larger (step S32: Yes), the flow shifts to step S37 to determine whether or not N is Nmax or larger. When it is determined that N is smaller than Nmax (step S37: No), it is considered that there remain the heating division areas (M, N) for which the temperature level subdivision is to be determined. In this case, M=1 and N=N+1 are set in step S38, and the flow returns to step S32. Thereafter, the processes from S33 to S35 are executed to complete the temperature level subdividing process for the heating division area in the subsequent column.

When N≥Nmax is determined in step S37 (step S27: Yes), it is considered that settings of the temperature levels have been completed for all the heating division areas (M, N). Accordingly, the flow returns to the flowchart in FIG. 12 to repeat the foregoing processes for all the pages.

According to this modified example, temperature level 1 is set only when it is determined that there is no heating division area set to temperature level 3 in the range of two blocks around and adjacent to the heating division area (M, N) in step S111. In this case, the areas set to temperature level 2 expand wide as illustrated in FIG. 11B, wherefore the distance from temperature level 3 to temperature level 1 increases. As a result, crinkles generated by a rapid temperature change decrease. When three or more temperature levels are established for non-printing areas, it is preferable that the temperature level corresponding to areas for expansion is at least the temperature level next to the highest temperature level (temperature level 3). This is because a rapid temperature change around the heating division area set to the highest temperature level is considered as the most influential factor in generation of crinkles resulting from the difference in the evaporated moisture amount between the respective parts of the recording sheet.

Figure 14:
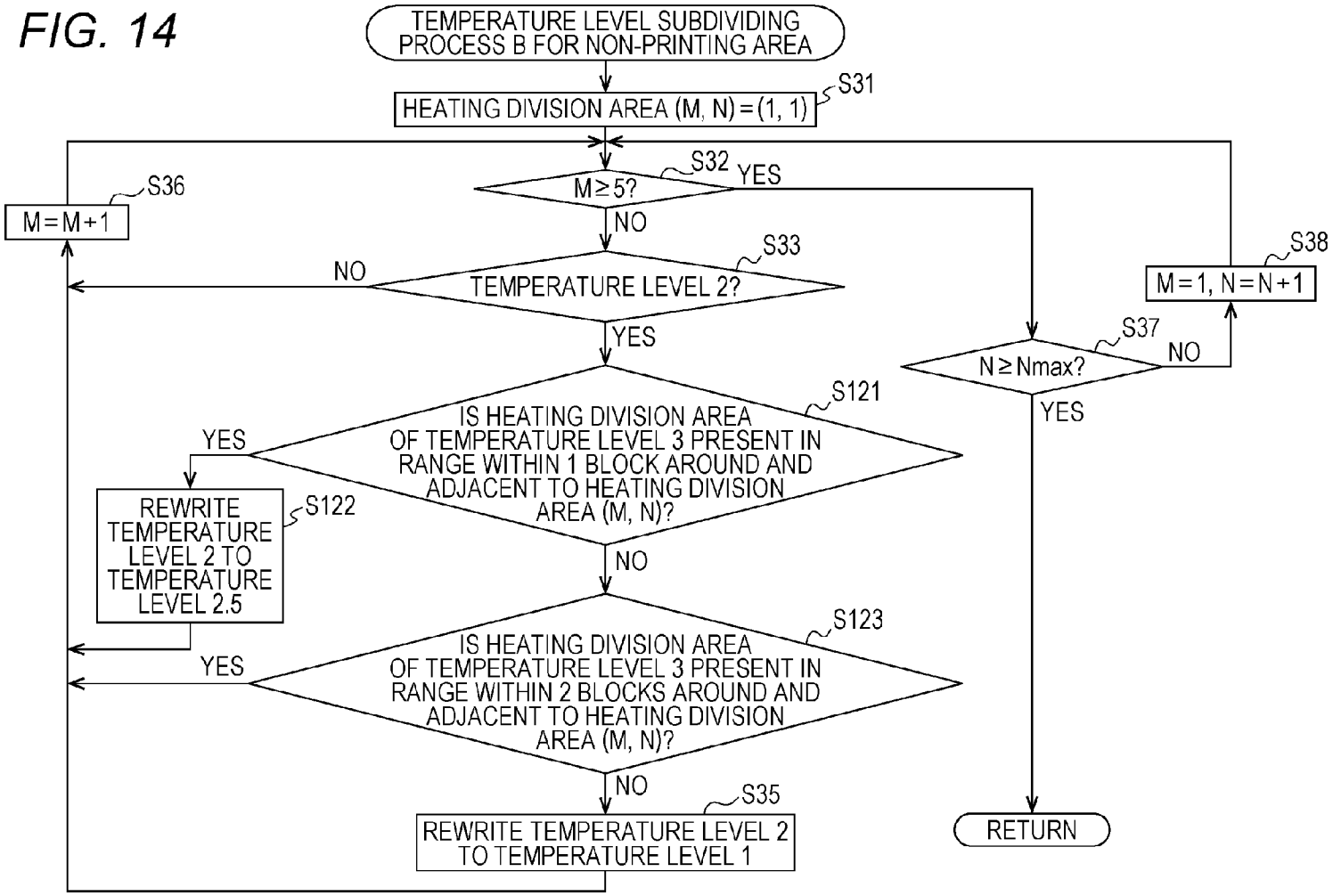
FIG. 14 is a flowchart describing the contents of a sub routine of the temperature level subdividing process B for a non-printing area executed in step S103 according to another modified example.

When a larger number of temperature levels are established for handling cardboard as illustrated in FIG. 11C, a flowchart shown in FIG. 14 is adopted in place of the flowchart of the temperature level subdividing process B for a non-printing area in FIG. 13.

The flowchart in FIG. 14 is different from the flowchart in FIG. 13 in processes from step S121 to step S123.

More specifically, it is determined whether or not the corresponding heating division area (M, N) is set to temperature level 2 with reference to the temperature level determination table in step S33. When it is determined that temperature level 2 has been set (step S33: Yes), it is determined whether or not there exists a heating division area set to temperature level 3 within the range of one block around and adjacent to the corresponding heating division area (M, N) (step S121).

When there exists a heating division area set to temperature level 3 within one block around the heating division area (M, N) (step S121: Yes), temperature level 2 is rewritten to temperature level 2.5 to avoid a rapid temperature change (step S122). Thereafter, the value M is incremented (step S36), and the flow returns to step S32.

On the other hand, when there exists no heating division area set to temperature level 3 within one block around the heating division area (M, N) (step S121: No), it is determined whether or not there exists a heating division area set to temperature level 3 within two blocks around the heating division area (M, N) (step S123). When there exists such a heating division area (step S123: Yes), the flow shifts to step S36 without the necessity of change of temperature level 2. However, when there is no heat division area set to temperature level 3 within two blocks around the heating division area (M, N), it is considered that heating division areas set to temperature level 2.5 and 2 are interposed between the heating division area (M, N) and the heating division area set to temperature level 3. In this case, a rapid temperature change is not caused when the temperature level is set to temperature level 1. Accordingly, temperature level 2 of the heating division area (M, N) is rewritten to temperature level 1 (step S35). After the change of the temperature level, the value M is incremented (step S36), whereupon the flow returns to step S32.

Other processes are executed similarly to the flowchart shown in FIG. 13 to set the temperature levels of heating division areas (M, N) in all the non-printing areas to temperature level 2.5, 2, or 1, and create the temperature level determination tables for these areas.

Discussed herein with reference to the flowcharts in FIGS. 12 to 14 are the temperature level determination table creating processes executed when the recording sheet as the fixing target is constituted by cardboard. However, these processes are similarly applicable to a configuration which raises the target value of the fixing temperature at temperature level 3 in accordance with the toner amount per unit area in the printing area.

(2) As described with reference to FIG. 6 and in step S34 in FIG. 10 in the foregoing embodiment, the temperature level of a particular heating division area (M, N) is set to temperature level 2 when there exists at least one heating division area set to temperature level 3 in all the blocks around and adjacent to the heating division area (M, N) in determining the temperature level of the heating division area (M, N).

However, the factor more influential in generation of crinkles is the temperature difference between the heating division area (M, N) and heating division areas in long contact with the heating division area (M, N) in the main scanning direction and in the sub scanning direction. In this case, the temperature difference between the heating division area (M, N) and a heating division area in contact with the heating division area (M, N) only at a point and disposed adjacent thereto in an oblique direction is not considered extremely important.

Accordingly, heating division areas 111, 112, 113, and 114 in FIG. 6, for example, may be set to temperature level 1, with priority given to power saving.

According to the invention of the present application, therefore, reduction of crinkles is achievable at least in comparison with the conventional technology when a temperature change amount per unit distance is adjusted to a value lower than a predetermined threshold at least in the main scanning direction and the sub scanning direction, rather than in arbitrary directions in the recording sheet surface.

This threshold is slightly variable in accordance with the thickness, type, size, moisture absorbability, and other conditions of the recording sheet, and therefore is calculated from experiments or others beforehand in practical situations.

The threshold may be calculated for each of conditions beforehand and registered in the ROM 54 or the like so that an optimum threshold can be selected and set based on conditions input from the user through the operation panel. When the lowest threshold of a plurality of thresholds is set beforehand, generation of crinkles is effectively prevented in any conditions.

(3) The control target temperatures in the respective temperature levels for non-printing areas may be changed in succession rather than in stages, or may be changed in a combined manner of successions and stages.

For example, the control target temperature for a heating division area in a non-printing area adjacent to a high-temperature heating division area set to temperature level 3 may be changed in succession for lowering the control target temperature as smoothly as possible. On the other hand, the control target temperature for a heating division area away from the area set to temperature level 3 may be changed in stages.

The number of temperature levels and the area of the intermediate temperature level for a non-printing area on the upstream side in the sheet conveying direction with respect to a printing area (the side initially fed into the fixing device) may be different from the number of temperature levels and the area of the intermediate temperature level for a non-printing area on the downstream side.

The temperature of the non-printing area located on the downstream side with respect to a printing area is lowered chiefly by draw of heat by the recording sheet. In this case, the temperature lowering speed is relatively moderate depending on the thickness of the recording sheet, the temperature of the outside air, and the heat capacities of the respective parts of the fixing device. When the temperature lowering speed is moderate, the number of the temperature levels and the area of the intermediate temperature level corresponding to temperature level 2 for a non-printing area on the downstream side with respect to a printing area may be set to a smaller number and a smaller area than the corresponding number and area for a non-printing area on the upstream side with respect to the printing area.

While the division number of the heating areas in the main scanning direction is five (A1 to A5) in the foregoing embodiment, this number is not limited to five. Finer temperature control is achievable as the division number increases. Finer temperature control contributes to further power saving.

The respective heating areas having equal widths as illustrated in FIG. 3 are not required to have equal widths. For example, each width of the heating areas located at both ends may be set to the half of the difference between a paper feed width L1 of a first recording sheet having the maximum size allowed for printing, and a paper feed width L2 of a second recording sheet in a size smaller than the maximum size, i.e., may be set to (L1−L2)/2. In this case, the necessity for heating the heating areas at both ends is eliminated at the time of fixation of the second recording sheet, wherefore further power saving is achievable. In addition, an excessive temperature rise of the fixing belt 31 in a part other than the paper feed portion is securely avoidable.

(4) Discussed in the foregoing embodiment has been the fixing device including the thermal head 34 equipped with the resistance heating elements 361 to 365. However, the present invention is applicable to other types of fixing devices as long as these fixing devices are heating units which can individually heat areas divided in the main scanning direction, and raise temperatures of the areas at a relatively high speed.

For example, the present invention is applicable to a structure which includes a plurality of halogen lamps disposed within a hollow portion of a cylindrical fixing roller, which halogen lamps have different heating areas in the main scanning direction, and individually receive supply of power.

When the fixing device is an electromagnetic induction type fixing device, a plurality of excitation coils may be arranged in the main scanning direction in such a condition that each of the excitation coils can be independently driven.

(5) While discussed in the foregoing embodiment has been a tandem color printer, the present invention is not limited to this specific example. The present invention is applicable to image forming apparatus such as facsimile, copying machine, and MFP (Multiple Function Peripheral) with a fixing device which performs thermal fixation. The present invention is also applicable to monochrome image forming apparatus.

According to the foregoing embodiment, the temperature control of the fixing device is performed by the control unit provided to control the overall operation of the printer. However, the temperature control may be performed by a control unit added and dedicated only for the control of the fixing device.

The contents of the foregoing embodiment and modified examples may be combined in any possible manners.

The present invention is applicable to a fixing device which individually heats a plurality of heating areas of the fixing device divided in a main scanning direction, offering a useful technology capable of reducing crinkling of a recording sheet while lowering power consumption as much as possible.

According to an embodiment of the invention, a fixing device performs temperature control for each of heating areas of the fixing device divided in a main scanning direction. For an image forming range, the temperature is adjusted to a target fixing temperature to maintain fixation. For a non-image forming range, the temperature is adjusted to a temperature lower than the target fixing temperature, and such a temperature at which a temperature change amount per unit distance of a recording sheet after fixation in a sub scanning direction and the main scanning direction becomes smaller than a predetermined value by changing heating target temperatures of respective heating units in stages and/or in succession. Accordingly, the fixing device of the embodiment prevents crinkling of the recording sheet while lowering power consumption of the fixing device as much as possible.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device which brings a recording sheet into contact with a heated fixing member for thermal fixation of the recording sheet where a not-fixed toner image is formed, while conveying the recording sheet in a sub scanning direction, the fixing device comprising:

a plurality of heating units which individually heat a plurality of areas of the fixing member divided in a main scanning direction;

an acquisition unit which acquires information on an image forming range and a non-image forming range of the recording sheet for each of the plurality of divided heating areas, the image forming range being a range where the toner image is formed in the sub scanning direction, and the non-image forming range being a range where the toner image is not formed in the sub scanning direction; and a control unit which performs first control for controlling the corresponding heating unit such that a contact portion of the image forming range of the recording sheet has a target fixing temperature for each of the heating areas when the image forming range contacts the fixing member at the contact portion of the image forming range, and second control for controlling the corresponding heating unit such that a contact portion of the non-image forming range of the recording sheet has a temperature lower than the fixing temperature for each of the heating areas when the non-image forming range contacts the fixing member at the contact portion of the non-image forming range, wherein, in the second control, the control unit changes the heating target temperature of the respective heating units in stages and/or in succession such that a temperature change amount per unit distance of the recording sheet after fixation does not become a predetermined value or larger both in the sub scanning direction and the main scanning direction.

2. The fixing device according to claim 1, wherein the control unit includes a fixing temperature changing unit which changes the target fixing temperature in accordance with a thickness of the recording sheet, or a toner application amount per unit area in the image forming range of the recording sheet, and in changing the heating target temperature in stages in the second control, the control unit increases the number of changeable levels of the heating target temperature as the target fixing temperature rises.

3. The fixing device according to claim 1, wherein the control unit includes a fixing temperature changing unit which changes the target fixing temperature in accordance with a thickness of the recording sheet, or a toner application amount per unit area in the image forming range of the recording sheet, and in changing the heating target temperature in stages in the second control, the control unit increases at least the area of the heating area set to a heating target temperature closest to the target fixing temperature as the target fixing temperature rises.

4. The fixing device according to claim 1, wherein the acquisition unit divides each of the heating areas of the recording sheet into blocks each of which has a predetermined length in the sub scanning direction, determines whether or not the toner image is present for each of the blocks, and acquires information on the image forming range and the non-image forming range.

5. An image forming apparatus comprising the fixing device according to claim 1.

* * * * *